United States Patent [19]

Henschel et al.

[11] Patent Number: 4,865,798

[45] Date of Patent: Sep. 12, 1989

[54] PROCESS AND APPARATUS FOR PRODUCING A FIBER WEB

[75] Inventors: Walter Henschel, Otzberg; Gerhard Melzer, Lautertal; Uwe Kunstmann, Robdorf, all of Fed. Rep. of Germany

[73] Assignee: Carl Schenck AG, Fed. Rep. of Germany

[21] Appl. No.: 191,213

[22] Filed: May 6, 1988

[30] Foreign Application Priority Data

May 25, 1987 [DE] Fed. Rep. of Germany ..... 87107597

[51] Int. Cl.[4] ..... B27N 1/00; B27N 3/10

[52] U.S. Cl. ..... 264/518; 264/115; 264/121; 425/82.1; 425/83.1

[58] Field of Search ..... 264/518, 115, 121; 425/80.1, 81.1, 82.1, 83.1

[56] References Cited

U.S. PATENT DOCUMENTS 3,482,287 12/1969 Flewwelling ..... 264/518
3,671,210 6/1972 Richardson ..... 425/83.1
3,792,943 2/1974 Helgesson ..... 425/83.1
4,123,211 10/1978 Rudloff ..... 425/83.1
4,701,294 10/1987 Radwanski et al. ..... 264/518

*Primary Examiner*—Jan H. Silbaugh
*Assistant Examiner*—Mary Lynn Fertig
*Attorney, Agent, or Firm*—Connolly & Hutz

[57] ABSTRACT

A process for the production of a fiber web on a movable, gas-permeable surface of a continuous laydown belt which is under vacuum and which forms a distribution chamber. After the fibers are mechanically opened, the fiber flow is conducted into the distribution chamber by means of an air current and additional air currents are delivered to the distribution chamber. An additional air current is introduced into the distribution chamber for the purpose of preventing a lumping together of fibers prior to the laydown in the web while the carrying air current is delivered to the distribution chamber in a nozzle-shaped chute. After the fibers have been laid down in a web, the web is precompressed by means of a controllable vacuum.

6 Claims, 1 Drawing Sheet

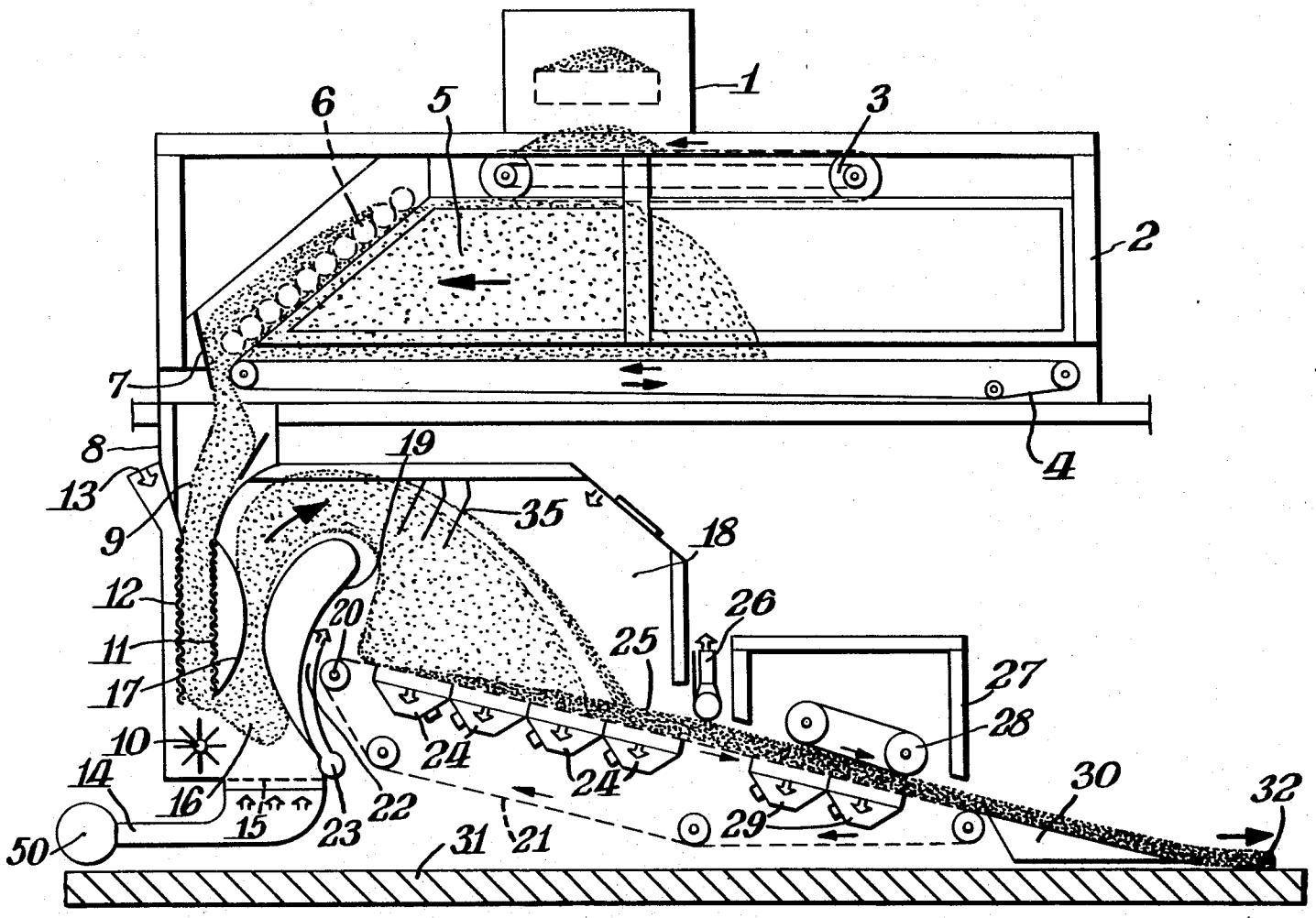
1
2
3
4
5
6
7
8
9
10
11
12
13
14
15
16
17
18
19
20
21
22
23
24
25
26
27
28
29
30
31
32
35
50

PROCESS AND APPARATUS FOR PRODUCING A FIBER WEB

BACKGROUND OF THE INVENTION

The present invention relates to a process for the production of a fiber web on a movable, gas-permeable surface of a continuous laydown belt which is under vacuum and which forms a distribution chamber. After the fibers are mechanically opened, the fiber flow is conducted into the distribution chamber by means of an air current and additional air currents are delivered to the distribution chamber.

German Preliminary Published Application 2 149 892 discloses a process of the above mentioned type for the production of fiber webs in which dry fibers are deposited on a gas permeable laydown belt which closes off a distribution chamber in downward direction. In this case, additional air currents are introduced into the distribution chamber to deflect the flow charged with fibers. These additional air currents are employed to prevent an uncontrollable fiber laydown in such a way that the fiber-charged vertical gas flow, when the distribution chamber is centered and in further travel in the direction of the laydown belt, follows a path similar to a ballistic curve or trajectory. This provides a separation of the incoming fibers according to their size in such a way that the coarser and heavier fibers are pushed farther out while the finer and lighter fibers are laid down via the shortest path to the laydown belt. This type of process makes an opening of the fibers impossible since, as a result of the different direction air currents, an agglomeraton of larger fiber particles or a clinging of smaller fiber particles to larger fiber particles is possible. When these bundles of fibrous lignocellulose particles are laid down in the web, a non-uniform web is obtained which in further processing to board-like articles leads to waste with respect to strength and density.

SUMMARY OF THE INVENTION

Based on the above, it is an object of the present invention to prevent lumping of unopened fibers prior to laydown in a web and at the same time to obtain a high density web.

In particular, as a result of employing a second air current having the same direction as the first air current for opening and transporting the fibers lumping of the opened fiber prior to the laydown of the fibers in the web is prevented while a subsequent precompression of the loose web at maintained vacuum prevents a rebounding of the precompressed fiber mat obtained thusfar without the application of vacuum.

The overall structure and processing parameters prevent sticking of the fiber to the walls of the chute in the feed area of the fiber.

As a result of the arrangement of an alignment base, the air current is designed as a parallel current and the nozzle-shaped tapering of the chute walls causes any lumped fiber still present to be opened. The additional air intake opening in front of the front return of the continuous belt prevents opened fiber from uncontrolled arrival on the laydown belt. Additional vacuum units provided near a precompressing area enhance the precompression pocedure by gas evacution from the laid down fiber web.

As a result of an air-permeable wall between the intake of the fiber and an additional air delivery opening, any caking of the fiber to be opened on the walls of the intake is prevented.

As a result of the arrangement of at least one turbulence-causing device at the ceiling of the distribution chamber, fiber agglomerations are prevented because constantly new turbulence is produced.

BRIEF DESCRIPTION OF THE DRAWING

Novel features and advantages of the present invention in addition to those noted above will become apparent to those of ordinary skill in the art from a reading of the following detailed description in conjunction with the accompanying drawing wherein similar reference characters refer to similar parts and in which:

The single FIGURE of drawing is a side elevational view of apparatus for producing a fiber web, according to the present invention.

DETAILD DESCRIPTION OF THE INVENTION

The exemplified embodiment represented in the drawing shows a production installation for particle board manufacture in which a fiber cover layer produced, according to the invention, is deposited on a particle board core. Fiber webs produced according to the invention may also be manufactured into fiber boards alone wihtout a particle board core.

In the present exemplified embodiment, fiber is deposited via a discharage 1 into a supply bin 2 via a distribution device 3. As a result of the travel of a floor conveyor 4 corresponding to the direction of the arrow, the fiber 5 is transported against delivery rolls 6 where the fibers are preopened and delivered to an opening device 8 via a delivery chute 7.

Fiber 5 is delivered through a chute 11 as a fiber flow 9 to an opening roll 10 which corresponds to the entire width of the future web. At least one side wall of the chute 11 consists of air-permeable material, and in the exemplified embodiment, the air-permeable material consists of a woven screen 12. Air also enters the opening device 8 through an additional opening 13. During the down flow of the fiber air also goes through the woven screen 12 so that caking of preopened fiber on the walls of the chute 11 is prevented.

Near the opening roll 10, an air current from a fan 50 enters the opening device 8 via a delivery duct 14 and an alignment base 15. This aligned, parallel air current is directed onto preopened fiber 16 and carries the fiber through a chute 17 which tapers in the shape of an adjustable nozzle into a distribution chamber 18. As a result of the velocity change of the air current produced by the adjustable nozzle-shaped tapering and widening chute 17, the fiber carried along is subjected to opening forces so that any remaining unopened fiber is opened. Since interfering air currents do not enter this area as a result of other air currents, a lumping of the opened material is clearly prevented. The nozzle leading to the distribution chamber may be made adjustable by any well known means.

Between the nozzle-shaped chute wall 19 and the return 20 of the laydown belt 21 moving in the direction indicated by the arrow, an additional air intake opening 22 is provided. This air intake opening also extends over the entire width of the fiber web to be formed. The air entering through intake opening 22 may be produced by an additional fan 23. Also a controlled amount of fiber may also be taken from the delivery duct 14 by a fan (not shown) and introduced into the distribution chamber 18 through the additional air intake opening 22. The additional air current prevents a caking of the opened fiber on the back of the nozzle-shaped chute wall 19 and, moreover, prevents opened fiber from settling in an uncontrolled manner on the laydown belt 21 in front of vacuum units 24 arranged under the laydown belt.

A fiber web 25 produced in this way in conducted under a leveling device 26 on the laydown belt 21 and delivered to a precompression device 27. In the precompression device, a belt press 28 is provided which travels according to the indicating arrow and causes a precompression of the fiber web 25 in cooperation with additional controllable vacuum devices 29. As a result of the air evacuation, according to the invention, of the fiber web by the additional controllable vacuum devices 29, a rebounding of the precompressed fiber web 25 is prevented. The web is then conducted over a separating wedge 30 and combined with a particle board core 31 produced in a known manner at a uniting site 32. A blank obtained in this way can then be cut in a known manner and pressed into artificial wood boards.

The present invention is not limited to the arrangement represented in the exemplified embodiment. Fiber boards without a particle board core may also be produced with such an apparatus.

Moreover, at the ceiling of the distribution chamber 18, turbulence-causing devices 35 are provided in the form of rods or grids which prevent the development of turbulence which would result in an agglomeration of opened fiber which of necessity would lead to a production of a non-uniform fiber web.

What is claimed is:

1. A process for producing a fiber web on a movable, gas-permeable surface of a continuous laydown belt under vacuum and which forms a distribution chamber whereby after the fibers are mechanically opened, fiber flow is conducted into the distribution chamber by means of an air current and additional air currents are delivered to the distribution chamber, the process comprising the steps of producing an air current over the entire width of a web to be formed before the distribution chamber for preopening fibers introduced into the air current, mechanically opening the preopeneed fibers, producing an additional controllable air current and introducing the fibers into that current, passing the fibers in the additional controllable air current through a chute with a nozzle-shaped tapering to further open the fibers and into the distribution chamber over the width of the web to be produced, vacuum depositing the fibers in the distribution chamber onto a continuous laydown belt, and precompressing the laid down web at maintained vacuum.

2. A process as in claim 1 wherein the additional controllable air current is introduced in the same direction as the fibers are introduced into the fiber flow.

3. Apparatus for producing a fiber web on a driven continuous, gas-permeable laydown belt forming the floor surface of a distribution chamber having vacuum means arranged below the belt, a chute arranged before the distribution chamber, the chute having an opening to the distribution chamber and an intake opening for the fiber to be distributed, a fiber opening device, air delivery means for transporting the opened fiber through the chute for the purpose of entering the distribution chamber, the chute having a bottom surface with openings therein for the introduction of air into the chute, the chute also having walls over the width of the web to be formed that define a nozzle-shaped tapering, means introducing additional air over the entire width of the web to be laid down between the laydown belt and exit of the nozzle-shaped tapering, vacuum units below the lay down belt for drawing fibers onto the belt, and additional vacuum units for precompressing the laid down fibers on the belt.

4. Apparatus as in claim 3 wherein the air delivery means includes an introduction location parallel to the intake for the fiber extending over the entire width of the web, and an air-permeable partition in the chute between that introduction location and the bottom surface with openings.

5. Apparatus as in claim 3 including at least one turbulence-causing device in the distribution chamber above the laydown belt.

6. Apparatus as in claim 3, wherein the nozzle-shaped tapering of the chute is adjustable.

* * * * *